US009669969B2

(12) United States Patent
Taylor

(10) Patent No.: US 9,669,969 B2
(45) Date of Patent: Jun. 6, 2017

(54) CONTAINER LID SECURING RING

(71) Applicant: GREIF INTERNATIONAL HOLDING BV, Vreeland (NL)

(72) Inventor: Dale Taylor, Hamilton Lake, IN (US)

(73) Assignee: GREIF INTERNATIONAL HOLDING BV, Vreeland (NL)

( * ) Notice: Subject to any disclaimer, the term of this patent is extended or adjusted under 35 U.S.C. 154(b) by 81 days.

(21) Appl. No.: 14/379,444

(22) PCT Filed: Feb. 15, 2013

(86) PCT No.: PCT/EP2013/053132
§ 371 (c)(1),
(2) Date: Aug. 18, 2014

(87) PCT Pub. No.: WO2013/121025
PCT Pub. Date: Aug. 22, 2013

(65) Prior Publication Data

US 2015/0028036 A1 Jan. 29, 2015

Related U.S. Application Data

(60) Provisional application No. 61/600,443, filed on Feb. 17, 2012, provisional application No. 61/661,282, filed on Jun. 18, 2012, provisional application No. 61/661,296, filed on Jun. 18, 2012.

(51) Int. Cl.
*B65D 45/34* (2006.01)
*B65D 21/02* (2006.01)

(52) U.S. Cl.
CPC ..... *B65D 45/345* (2013.01); *B65D 21/022* (2013.01); *B65D 21/0219* (2013.01)

(58) Field of Classification Search
CPC .. B65D 45/345; B65D 21/022; Y10T 292/216
USPC ..... 220/319–321; 206/511; 292/256.69; 215/275
See application file for complete search history.

(56) References Cited

U.S. PATENT DOCUMENTS 3,091,489 A 5/1963 Vaughn et al.
4,194,772 A 3/1980 Hurd et al.
4,678,216 A 7/1987 Gregory
(Continued)

FOREIGN PATENT DOCUMENTS

DE 7532842 U 3/1976
DE 3915132 A1 11/1990
(Continued)

*Primary Examiner* — Anthony Stashick
*Assistant Examiner* — Robert Poon
(74) *Attorney, Agent, or Firm* — Baker & Hostetler LLP

(57) ABSTRACT

An openable securing ring for holding a lid or similar closure on a container has a latch mechanism arranged to secure ends of the ring releasably together at a circumferential break. A circumferentially extending recess is provided at a radially inner portion of the latch mechanism so that the radially inner portion is of reduced axial external thickness and provides relief for stable stacking of a first container on top of a second container when the securing ring is attached to the second container. A radially inner edge of a locking lever side wall may lie radially outward of the inner diameter of one ring end to define at least part of the reduced thickness radially inner portion.

13 Claims, 6 Drawing Sheets

(56) References Cited

U.S. PATENT DOCUMENTS

| | | | | |
|---|---|---|---|---|
| 5,026,360 | A | 6/1991 | Johnsen et al. | |
| 5,129,537 | A | 7/1992 | Bordner et al. | |
| 5,219,088 | A * | 6/1993 | Reina | B65D 45/345 220/321 |
| 5,284,270 | A * | 2/1994 | Kusta | B65D 43/0233 220/321 |
| 5,713,482 | A * | 2/1998 | Bordner | B65D 45/345 220/320 |
| 5,947,320 | A * | 9/1999 | Bordner | B65D 43/0218 220/321 |
| 6,019,240 | A * | 2/2000 | Legeza | B65D 45/345 220/319 |
| 7,243,962 | B2 | 7/2007 | Stolzman | |
| 2006/0097524 | A1 | 5/2006 | Stolzman | |
| 2006/0220395 | A1 | 10/2006 | Kuzelka | |
| 2009/0294449 | A1 | 12/2009 | Taylor | |
| 2013/0037544 | A1 | 2/2013 | Brandt | |

FOREIGN PATENT DOCUMENTS

| | | | |
|---|---|---|---|
| DE | 8631933 | U1 | 4/1992 |
| DE | 9215713 | U1 | 1/1993 |
| FR | 2633255 | A1 | 12/1989 |

* cited by examiner

CONTAINER LID SECURING RING

CROSS-REFERENCE TO RELATED APPLICATIONS

This application is a National Stage of International patent application Ser No. PCT/EP2013/053132, filed Feb. 15, 2013, which claims priority to U.S. Provisional Application No. 61/600,443, filed Feb. 17, 2012, U.S. Provisional Application No. 61/661,282, filed Jun. 18, 2012, and U.S. Provisional Application No. 61/661,296, filed Jun. 18, 2012, the disclosures of which are incorporated by reference in their entirety.

FIELD OF THE INVENTION

This invention concerns a securing ring for holding a lid or similar closure on a container, the ring for example being of the kind having an inwardly facing, circumferentially extending groove arranged to trap a rim of the lid/closure and also trap a peripheral flange or similar radial extension (s) provided around an opening in the container. In this way the lid rim and container flange are locked together.

INVENTION BACKGROUND

Where the ring is re-useable, it is typically openable to allow installation over or removal from the flange and rim. Then the ring will usually comprise a circumferential discontinuity which forms a pair of overlappable or opposed ends which are releasably secured together by a releasable fastening or latch mechanism. The groove profile will often be tapered, to draw the flange and rim into engagement with each other as the ring is tightened, and optionally to draw the flange and rim into clamping engagement with an interposed sealing gasket. However such clamping and/or sealing functions need not always be present. Optionally, the ring end fastening or latch mechanism may be provided with an anti-tamper lock pin or similar tamper indicating security seal or tag, to provide some guarantee of the integrity of the container contents. The container and its opening may be of various sizes and shapes, with lids or other closures of a suitable corresponding size and shape. For example the opening and lid may be substantially square, rectangular or other polygonal shape. Typically the lid or closure is round, for fitment to an open-ended cylindrical drum. In the North American market, fibreboard drums with steel end chimes are commonly used together with injection moulded lids. Open-topped blow-moulded plastics drums are also used, again with injection moulded plastics lids. The blow moulded drums predominate in other markets.

Historically the openable securing rings have been made from metal, commonly painted or plated steel. However these are difficult to recycle and are prone to corrosion, or to flaking of the coating. Corrosion or coating particles shed by the ring can contaminate the container contents. There is therefore an increasing use of securing rings made from plastics. U.S. Pat. Nos. 4,194,772, 4,678,216, 5,129,537, 5,713,482, 7,243,962 and US2009/0294449 relate to such plastics securing rings.

To be strong enough to survive normal rough handling of the filled containers, plastics securing rings need to be made with a heavier (thicker) cross-section than a corresponding metal ring. Similarly, the releasable fastening or latch mechanism for the openable ring ends tends to be significantly bulkier in a plastics ring compared to a metal ring. This can lead to a number of problems. One such problem is in container stackability.

During transport and storage it may be desired to stack several layers of containers one on top of another. The lids and bases of the containers described above can be deliberately designed to interfit, so as to improve stacking stability. Or the containers, being of regular shape, can simply be piled up in orderly layers, without interfitting. Bulky securing ring latch or fastening mechanisms can protrude to such an extent that they interfere with the stable and orderly stacking of the containers in layers. The mechanism may project axially of the ring so that it either stands proud of the top surface of the associated container lid, or else projects into the space designed to be occupied by part of an adjacent interfitted container. This part may be, for example, a container base end chime which is designed to fit over and around part of the lid of a container below. The upper container in the stack is thereby prevented from resting squarely on the lower container and will instead lean at an angle and be free to rock, reducing the stack stability and preventing the containers from packing closely together. If one attempts to stack still further layers, leaning of the containers becomes more exaggerated, and each higher layer ever more disorderly, until further stacking may soon be impossible. The weight of the containers above will also impose high transverse loading directly on the ring latch or fastening mechanisms, which have to support up to half of this weight. The ring fastening mechanisms will similarly experience high inertial loads from the containers during transit, in both cases leading to a risk of crushing and failure. The problem is particularly acute in the case of the relatively bulky plastics mechanisms, but can still arise with metal ring latches/fastenings. A crushed metal ring fastening mechanism could jam and make the ring difficult to remove. A crushed plastics ring fastening mechanism is liable to fail completely, potentially releasing the lid and allowing the container contents to spill.

SUMMARY OF THE INVENTION

To mitigate the above problems, the present invention provides a securing ring for holding a lid or similar closure on a container. The securing ring comprises a circumferential discontinuity which forms a pair ring ends, and a releasable fastening or latch mechanism arranged to secure the pair of ring ends releasably together. The releasable fastening or latch mechanism has a radially inner portion. A recess is provided at the radially inner portion and throughout the entire circumferential extent of the releasable fastening or latch mechanism in the securing ring so that the radially inner portion is of reduced axial external thickness relative to a radially outer portion of the releasable fastening or latch mechanism and provides relief for stable stacking of a first container on top of a second container when the securing ring is attached to the second container.

The releasable fastening or latch mechanism may comprise a lever joined to one of the pair of ends by a first pivotable connection and to the other of the pair of ends by a second pivotable connection.

The lever may be movable between a generally radially extending position in which the pair of ring ends are in a released condition, and a generally tangential position in which the pair of ends are secured together.

The lever may comprise: an elongate top wall which, with the lever in the generally tangential position, lies radially outward of at least one of the secured ring ends, and a pair of opposed side walls, co-extensive with the top wall and lying axially to either side of the one secured ring end, so as to form, together with the top wall, a channel in which the one secured ring end is at least partially received.

With the lever in the generally tangential position, a radially inner edge of at least one of the lever side walls lies radially outward of the inner diameter of the one ring end to define at least part of the radially inner portion of reduced axial external thickness.

The other of the pair of ring ends may comprise an opposed pair of further walls lying axially to either side of the ring and between which the lever is mounted by the second pivotable connection, and, with the lever in the generally tangential position, a radially inner edge of at least one of the further walls may lie at least as far radially outward as the at least one lever side wall radially inner edge, to define at least part of the radially inner portion of reduced axial external thickness. The securing ring may comprise a main part having a profile which is extended into said other of the pair of ring ends between said further side walls.

The ring and the releasable fastening or latch mechanism may be substantially symmetrical in cross-sectional profile, whereby the ring may be mounted to a container and container lid either way up.

The above and other preferred features and advantages of the invention are further described below with reference to illustrative embodiments of the invention shown in the drawings.

DETAILED DESCRIPTION OF THE PREFERRED EMBODIMENTS

Figure 1:
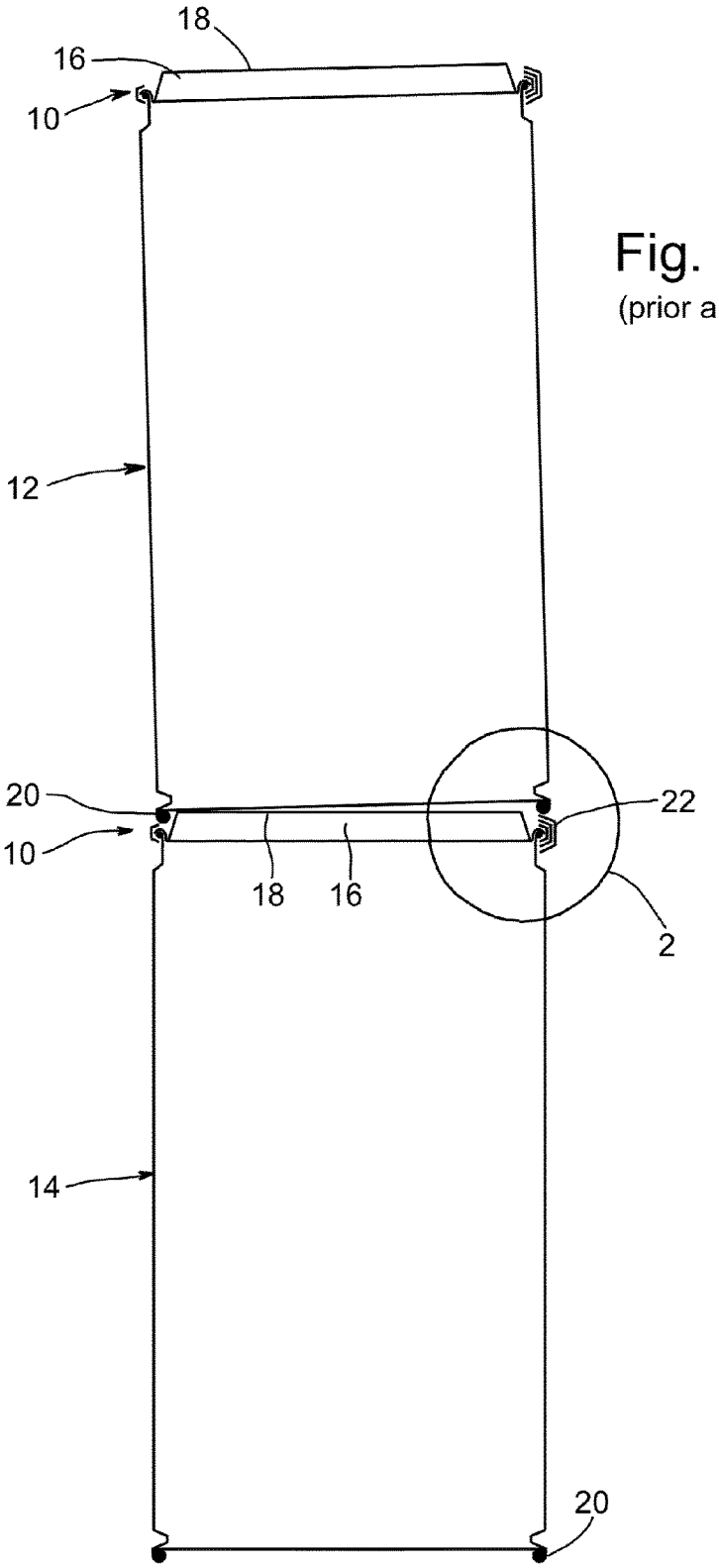
Fig. 1 (prior art)
FIG. 1 is a cross-sectional view illustrating leaning and instability induced by interference of a prior art securing ring latch mechanism to prevent the proper interfitting of a pair of stacked fibre drums.
Figure 2:
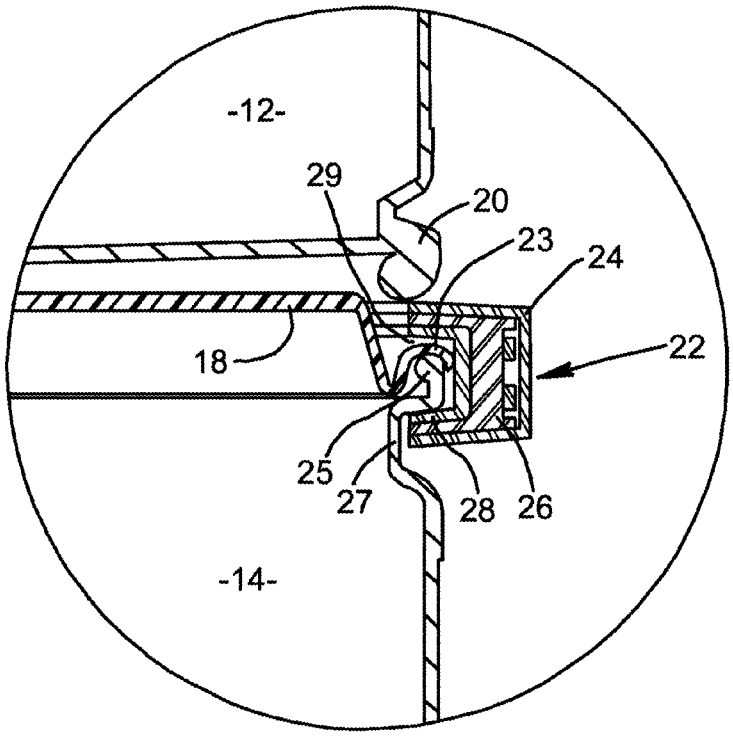
Fig. 2 (prior art)
FIG. 2 is an enlarged view of the latch mechanism and adjacent drum chimes of FIG. 1.

For illustrative and comparative purposes, a prior art all-plastics lock ring 10 and a pair of fibre drum containers 12, 14 are shown in FIGS. 1 and 2. FIG. 2 shows the portion 2 circled in FIG. 1, drawn to a larger scale. Each container 12, 14 is provided with a respective lid 16. An upstanding central portion 18 of each lid 16 has a large, substantially flat top surface. The lid upstanding portion 18 is dimensioned to fit snugly within a bottom end chime 20 of another container of the same type as the one to which the lid 16 is fitted as a closure. Thus multiple lidded containers 12, 14 may be stably and securely stacked one on top of another, with the base of each upper container supported over a large area in face-to-face contact with the lid of the container below.

However a problem arises through use of the prior art all-plastics securing ring 10 to secure each lid 16 on its respective container 12, 14. Each lid 16 is formed with a downwardly facing peripheral channel 23 surrounding the upstanding central portion 18. A recessed top end chime 27 of the container 12, 14 is provided with an upstanding L-profiled flange 25 extending radially outwardly and then upwardly. The lid peripheral channel 23 is dimensioned to fit over and receive the upwardly extending terminal wall portion of the flange 25. The ring 10 has an inwardly facing, circumferentially extending groove 29 arranged to trap the interengaged channel 23 and flange 25, so as to secure the lid 16 in position and close the open top end of the container 12, 14. Optionally, a sealing gasket may be provided in the channel 23, for sealing co-operation with the flange 25. Side walls of the ring groove 29 converge in the radially outward direction so as to clamp the lid peripheral channel and top end chime flange 25 into tight engagement with each other as the ring 10 is constricted about these components. To allow for such constriction, the ring 10 is provided with a suitable releasable fastening or latch mechanism 22. A detailed description of a prior art ring, provided with a suitable releasable fastening or latch mechanism, appears in U.S. Patent Application Publication No. US2009/0294449 to Dale W. Taylor, filed May 28, 2009, published on Dec. 3, 2009 and entitled "Polymer Drum Ring and Lever System", the entire content of which is hereby incorporated herein by reference. Such a ring 10 and latch mechanism 22 is shown in cross-section in present FIGS. 1 and 2. The latch mechanism comprises an outer ring end 24 of channel-shaped cross-section, an operating lever 26 of similar but reduced cross-section mounted within the ring end 24, and an inner ring end 28 again of similar but reduced cross-section, mounted within the lever 26. The lever is pivotally connected to both ring ends and is movable from a generally radial position in which the ring is expanded and so may be installed about or removed from the flange 25 and channel 23; to a generally tangential position as shown in FIGS. 1 and 2, in which the ends 24, 28 and lever 26 adopt a nested, overlapping configuration as shown, and hold the ring in its constricted condition. To withstand the rough handling that the filled containers will often be exposed to in everyday use, the all-plastics ring 10 and in particular its latch mechanism 22 have to be made suitably robust. This necessitates the use of suitably large component cross-sections to confer the necessary strength. The overall size and bulk of the latch mechanism 22 is such that its overlapping and nested components 24, 26, 28 intrude into the space normally intended to be occupied by the corresponding portion of the bottom end chime 20 of the container 12. This interferes with the proper stacking of the containers 12, 14. Rather than the upstanding portion 18 of the lid of the lower container 14 resting squarely against the base of the upper container 12 with the lower end chime projecting downwardly into free space above the entire circumference of the ring 10, instead a short portion of the circumference of the lower end chime 20 is supported on the latch mechanism 22. This causes the upper container to cant over at an angle. The flat surface of the container lid upstanding part 18 and the corresponding bottom end of the supported container 12 are held out of face-to-face contact. The upper container is thus free to rock, which together with the canting, disrupts the stacking of the containers in orderly layers. There is also high loading and stress acting through the small patch contact between the lower end chime 20 and latch mechanism 22, and through the remaining patch contact between the lid portion 18 and upper container base diametrically opposite to the latch mechanism. There is a consequent high risk of damage to these parts, and of failure of the latch 22.

Similar problems can arise with a metallic ring and latch, with a risk of crushing and jamming of the latch.

Figure 3:
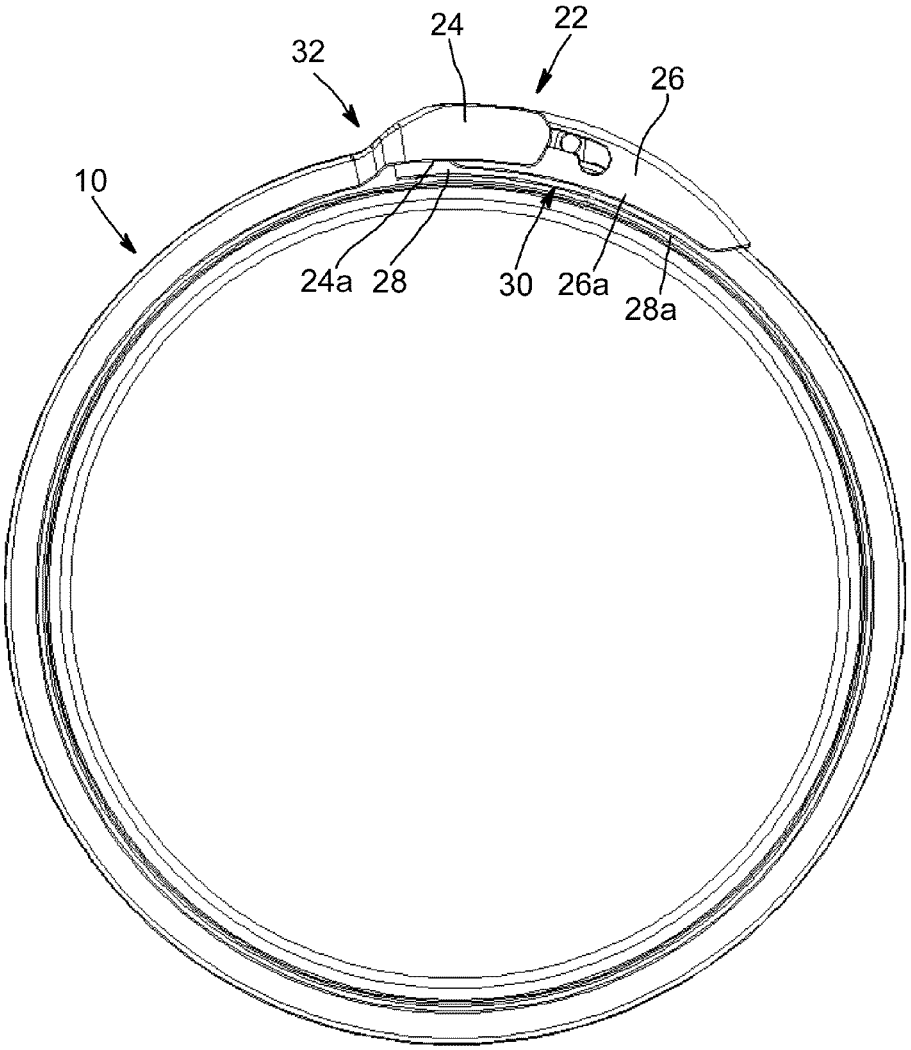
FIG. 3 is a top plan view of a securing ring and latch mechanism embodying the invention.
Figure 4:
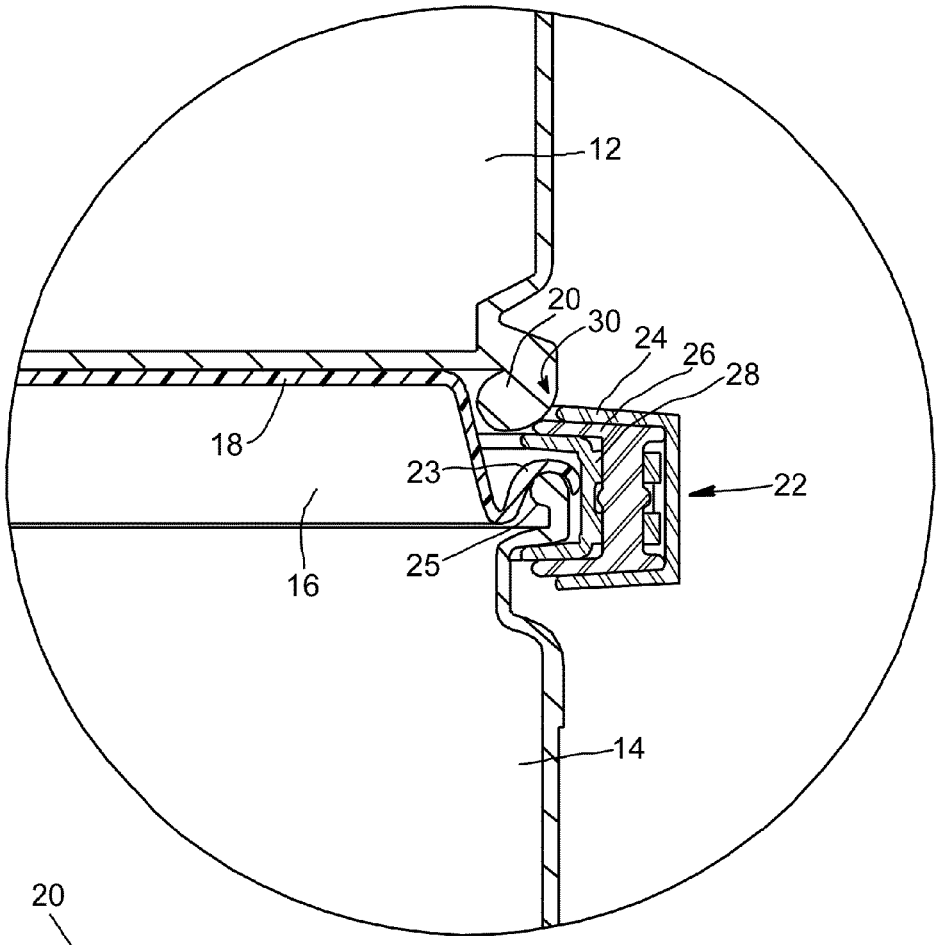
FIG. 4 is a cross-sectional view corresponding to FIG. 2 but showing the embodiment of FIG. 3.
Figure 4A:
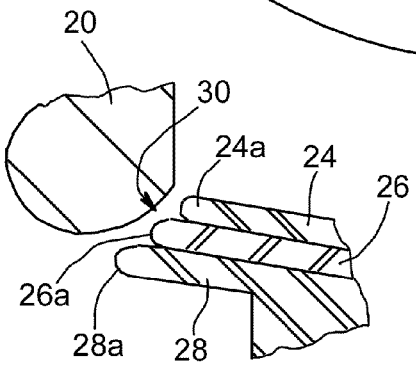
FIG. 4*a* is a scrap view of part of FIG. 4 drawn to a still larger scale.
Figure 5:
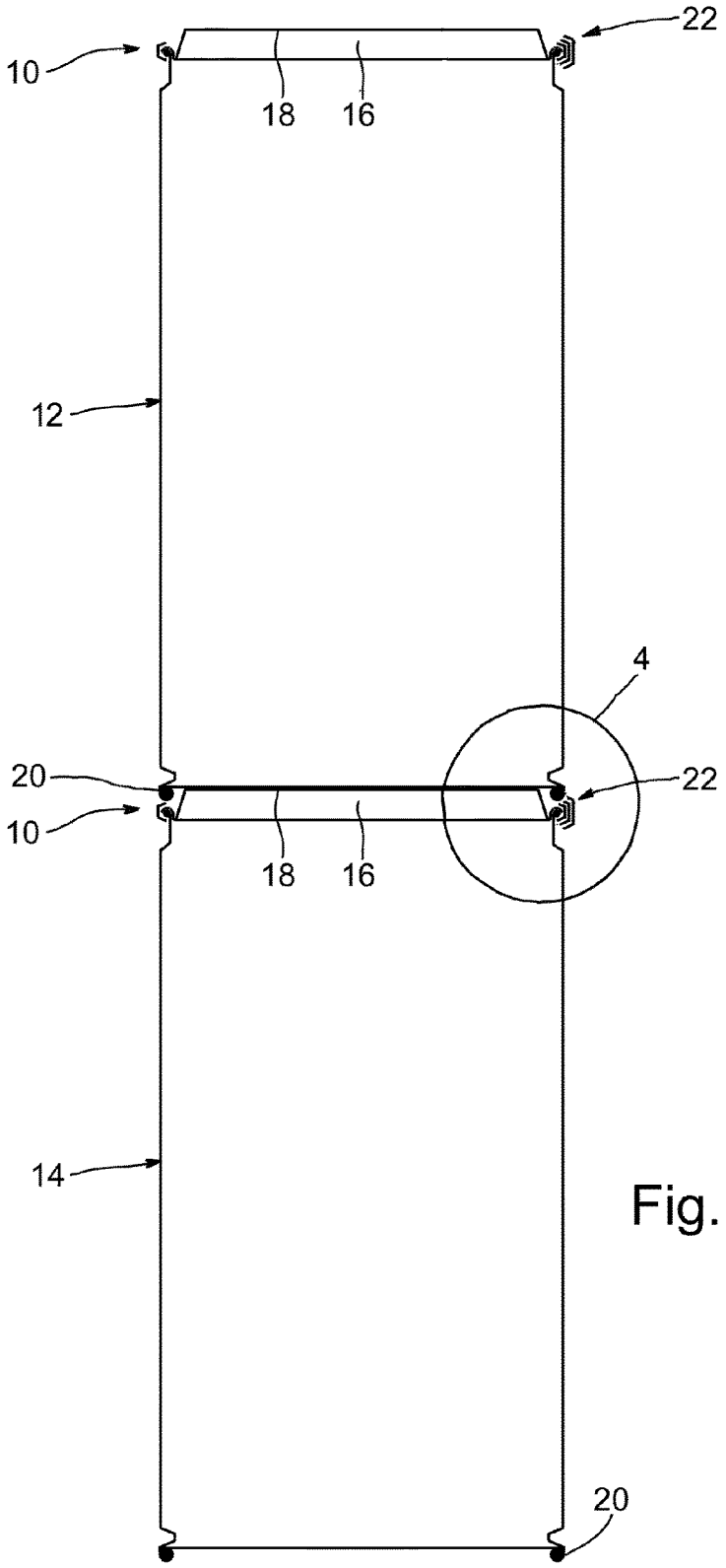
FIG. 5 is a cross-sectional view corresponding to FIG. 1 but again showing the embodiment of FIG. 3.

To mitigate these problems, as shown in FIGS. 3-5 a radially inner portion of the releasable fastening or latch mechanism 22 has a circumferentially extending recess 30 so that the axial external thickness of the radially inner portion is reduced. In this embodiment of the invention, the latch mechanism is otherwise similar in structure and operation to the latch mechanism shown in FIGS. 1 and 2. It is of all plastics construction and comprises an outer ring end 24 of channel-shaped cross-section, an operating lever 26 of similar but reduced cross-section mounted within the ring end 24, and an inner ring end 28 again of similar but reduced cross-section, mounted within the lever 26. The operating lever is mounted and movable as described above with reference to FIGS. 1 and 2. However, to provide the circumferentially extending recess 30, a side wall of the channel shaped ring outer end 24 has a free edge 24*a* (see FIGS. 3 and 4*a*) which terminates radially outwardly of a free edge 26*a* of the lever 24 side wall. Similarly the lever side wall free edge 26*a* terminates radially outwardly of the free edge 28 of the channel-shaped ring inner end 28. In this way, all three channel free edges 24*a*, 26*a*, 28*a* in the latch mechanism form the boundary to the recess 30 and terminate just short of the upper container 12 bottom end chime 20 when the container 12 is stacked on top of the container 14. At the region where the bottom end chime 20 crosses the ring latch mechanism 22, the bottom end chime is therefore received within the recess 30. This contrasts with the arrangement shown in prior art FIG. 2, where the free edges of the latch components 24, 26, 28 all terminate at substantially the same ring radius and therefore block and interfere with the desired positioning of the upper container 12 bottom end chime 20, when endeavouring to stack the container 12 on top of the container 14. As shown in FIGS. 4 and 5, (FIG. 4 showing the region 4 in FIG. 5 on a larger scale) using a securing ring in accordance with the present invention, the bottom the container 12 is instead able to rest flat in face-to-face contact with the upstanding central part 18 of the lid 16 of the lower container 14. The upper container 12 is therefore stably supported upright with loads distributed over a wide area of its base and over a wide area of the supporting container lid 16, without imposing any additional load on the latch mechanism 22.

Many variants to the above described embodiment are possible within the scope of the invention. For example, the free edge 26*a* can terminate at substantially the same as, or even a larger ring radius than, the free edge 24*a;* so long as free edge 24*a* terminates at a sufficiently large ring radius to accommodate the upper container bottom end chime when the two containers are stacked. However an arrangement as shown in FIGS. 4 and 4*a*, in which the various free edges closely follow the contour of the end chime 20 when the containers are squarely and stably stacked, is usually optimal. This maximises the available cross-section of the latch mechanism and therefore its strength. Although the height of the lever and ring outer end side walls is reduced in FIG. 4 compared to FIG. 2, it has been found that it is still possible to achieve the necessary latch mechanism strength, e.g. by suitably increasing the component wall thicknesses. For the opposing, lower side walls of the ring inner and outer ends and the opposing, lower side wall of the latch operating lever, the configuration as shown in FIG. 2 can be retained in other embodiments of the invention, where the container upper end chime profile 27 so permits. Indeed, any profile that is a compatible fit with the container upper end chime can be used for the lower part of the latch mechanism or releasable fastener, within the scope of the invention, since the latch mechanism or releasable fastener lower part does not interface with the upper container lower end chime. However a symmetrical releasable fastener/latch mechanism cross-sectional profile (as shown in FIG. 4) allows the securing ring 10 to be used either way up.

Figure 6:
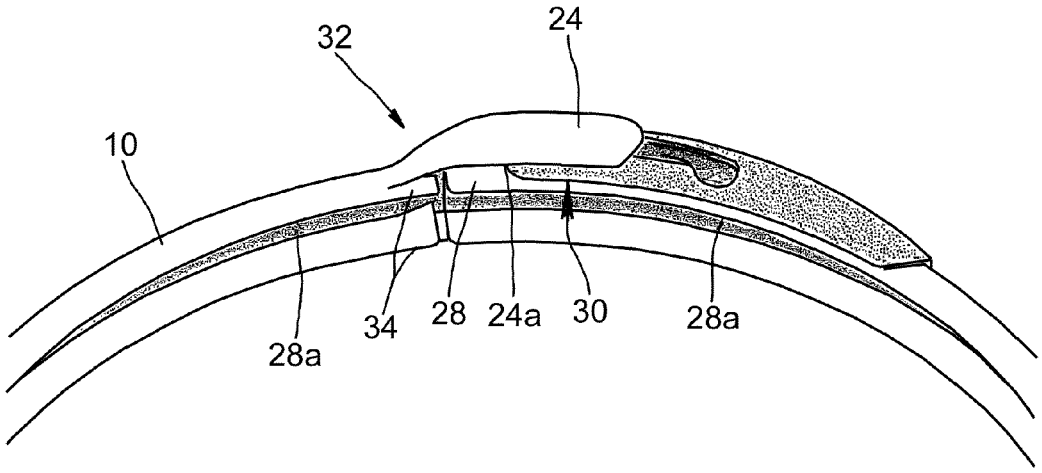
FIG. 6 is a partial perspective view of a second securing and latch ring embodying the invention.

FIG. 6 shows a further embodiment of the invention. In this and the previously described embodiments, there is a transition region 32 where the smaller cross-sectional profile of the main part of the ring 12 merges into the outer ring end 24. The presence of the circumferential recess 30 extending through this region reduces the height of the side wall of the ring/outer ring end, causing a potential weak point in this locality. Therefore for added strength, the profile of the ring main part (particularly its side walls) is continued through the transition region into the interior of the outer ring end 24, to provide a ring extension 34. As a result, the ring has double side walls in the transition region 32. The height of the side walls of the ring extension 34 may be made at least equal to the height of the side walls in the main part of the ring 10 as formed in regions away from the ring ends constituting part of the latch mechanism 22, and the extension 34 is therefore of similar strength to the ring in general. It is preferred that the lower edges of the extension side walls follow and form an extension of the circular profile of the corresponding side wall edges in the main part of the ring 10. As the radially outwardly disposed top wall of the outer ring end 24 has a larger radius than the remainder of the ring 10, the overall height of the side walls of the extension 34 is increased so that the side walls still meet the ring outer end top wall as shown in FIG. 6. The space between the double walls may be filled with solid plastics, may be left void, or may be bridged by stiffening/strengthening webs as desired. The extension 34 also serves to reduce the gap between the main part of the ring 10 and the inner ring end 28 when the ring 10 is secured about the flange 25 and lid rim 23, so that the ring clamping force is applied around substantially the entire circumference of the flange 25 and rim 23. This helps to hold the lid 16 more securely in place and to ensure that any sealing gasket between flange and rim is more evenly energised.

The invention claimed is:

1. A securing ring for holding a lid or other closure on a container, the securing ring comprising:

a circumferential discontinuity which forms a pair of ring ends, and a releasable fastening or latch mechanism configured to secure the pair of ring ends releasably together, the releasable fastening or latch mechanism and the pair of ring ends comprising respective radially aligned inner portions, wherein:

the releasable fastening or latch mechanism comprises a lever joined to one of the pair of ring ends by a first pivotable connection and to the other of the pair of ring ends by a second pivotable connection;

the lever is movable between a generally radially extending position where the pair of ring ends are in a released condition, and a generally tangential position where the pair of ring ends are secured together;

the lever comprises:

an elongate top wall which, when the lever is in the generally tangential position, lies radially outward of at least one of the secured pair of ring ends, and a pair of opposed side walls, co-extensive with the top wall and lying axially to either side of one secured ring end, to form, together with the top wall, a channel in which the one secured ring end is at least partially received;

when the lever is in the generally tangential position, a radially inner edge of at least one of the side walls lies radially outward of an inner diameter of the secured one ring end to define one of the radially aligned inner portions of reduced axial external thickness;

the other of the secured pair of ring ends comprises an opposed pair of further walls lying axially to either side of the securing ring and between which the lever is mounted by the second pivotable connection;

when the lever is in the generally tangential position, a radially inner edge of at least one of the further walls lies at least as far radially outward as the at least one lever side wall radially inner edge, to define another of the radially aligned inner portions of reduced axial external thickness; and a recess is provided at the radially aligned inner portions and throughout an entire circumferential extent of the releasable fastening or latch mechanism and the pair of ring ends such that the radially aligned inner portions are of reduced axial external thickness relative to a radially outer portion of the releasable fastening or latch mechanism and the pair of ring ends, and provide relief for stable stacking of a first container on top of a second container when the securing ring is attached to the second container.

2. The securing ring of claim 1, wherein the securing ring is made of a plastic.

3. The securing ring of claim 1, wherein the securing ring comprises a main part having a profile which is extended into said other of the pair of ring ends between said further walls.

4. The securing ring of claim 1, wherein the securing ring and the releasable fastening or latch mechanism are substantially symmetrical in cross-sectional profile, whereby the securing ring is configured to be mounted to the container or container lid either way up.

5. A securing ring for holding a lid or other closure on a container, the securing ring having an inner diameter and comprising:

a circumferential discontinuity which forms a pair of ring ends; and a lever comprising a lever side wall, the lever being movable between a generally radially extending position where the pair of ring ends are held in a released condition, and a generally tangential position where the pair of ring ends are held secured together, wherein the lever side wall comprises a radially inner edge which lies radially outward of the inner diameter of the securing ring with the lever in the generally tangential position, wherein an outer one of the pair of ring ends comprises an outer end side wall lying outwardly of the lever side wall in an axial direction of the securing ring, and wherein the outer end side wall comprises a radially inner edge which lies radially outward of the inner diameter of the securing ring.

6. The securing ring of claim 5, wherein the lever joined to one of the pair of ring ends by a first pivotable connection and to the other of the pair of ring ends by a second pivotable connection.

7. The securing ring of claim 5, wherein the lever comprises:

an elongate top wall which, when the lever is in the generally tangential position, lies radially outward of at least one of the secured pair of ring ends, and a second side wall, the side wall and second side wall being co-extensive with the top wall and lying axially to either side of one secured ring end, to form, together with the top wall, a channel in which the one secured ring end is at least partially received.

8. The securing ring of claim 6, wherein:

the outer ring end comprises an opposed pair of outer end side walls lying axially to either side of the securing ring and between which the lever is mounted by the second pivotable connection, and when the lever is in the generally tangential position, a radially inner edge of at least one of the outer end side walls lies at least as far radially outward as the lever side wall radially inner edge.

9. The securing ring of claim 8, wherein the securing ring comprises a main part having a profile which is extended into said outer ring end between said opposed pair of outer end side walls.

10. The securing ring of claim 5, wherein the securing ring and the lever are substantially symmetrical in cross-sectional profile, whereby the securing ring is configured to be mounted to the container or container closure either way up.

11. The securing ring of claim 5, wherein the lever comprises an opposing side wall comprising a radially inner edge which lies radially outward of the inner diameter of the securing ring.

12. The securing ring of claim 11, wherein:

said outer ring end comprises an opposing side wall lying outwardly of the lever opposing side wall axially of the securing ring; and said opposing side wall of the outer ring end comprises a radially inner edge which lies radially outward of the inner diameter of the securing ring.

13. The securing ring of claim 5, wherein the securing ring is made of a plastic.

* * * * *